United States Patent [19]

Heinrich et al.

[11] 4,066,105

[45] Jan. 3, 1978

[54] METHOD OF AND APPARATUS FOR FORMING A LENO SELVAGE ON WOVEN GOODS

[75] Inventors: Felix Heinrich, Balingen; Adolf Linka, Hechingen-Sickingen; Reinhold Jocham, Strassberg, all of Germany

[73] Assignee: Mayer & Cie, Tailfingen, Germany

[21] Appl. No.: 728,011

[22] Filed: Sept. 29, 1976

[30] Foreign Application Priority Data

Oct. 3, 1975 Germany ..... 2544199

[51] Int. Cl.[2] ..... D03D 47/40

[52] U.S. Cl. ..... 139/54

[58] Field of Search ..... 139/54

[56] References Cited

U.S. PATENT DOCUMENTS

| | | | |
|---|---|---|---|
| 3,280,852 | 10/1966 | Rietzler | 139/54 |
| 3,376,899 | 4/1968 | Quintana | 139/54 |
| 3,720,236 | 3/1973 | Strauss | 139/54 |
| 3,871,414 | 3/1975 | Palencher | 139/54 |

*Primary Examiner*—Henry S. Jaudon
*Attorney, Agent, or Firm*—Michael J. Striker

[57] ABSTRACT

A loom having harnesses carrying an array of warp yarns defining a warp direction and displaceable in a shed direction transverse to this warp direction to form a main shed adapted to receive a weft passed through the shed in a weft direction transverse to the warp and shed directions has a leno selvage device. This device comprises at least one ground heddle at an edge of the array of warp yarns which carries a ground warp yarn. There is also provided a doup heddle at this edge which carries a doup warp yarn. One of these heddles is displaced synchronously toward the other heddle with the harnesses of the loom to form an edge shed in line with the main shed. A support is provided which defines a rocking axis nondisplaceable in the weft direction and a rocker is pivotal on the support about this axis between a pair of end positions. The doup heddle is operatively engageable with this rocker and can be deflected thereby in the weft direction to either side of the ground heddle. On each shedding operation the rocker is moved from one to the other position so that the doup heddle is alternately deflected to one side and the other of the ground heddle so as to form a leno selvage at the edge of the woven goods.

12 Claims, 11 Drawing Figures

III
III

FIG.8
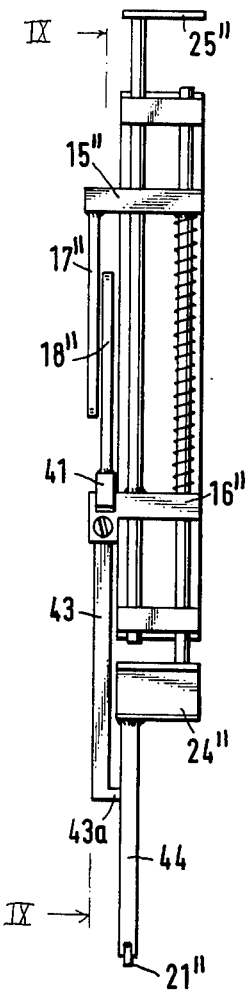
FIG.9
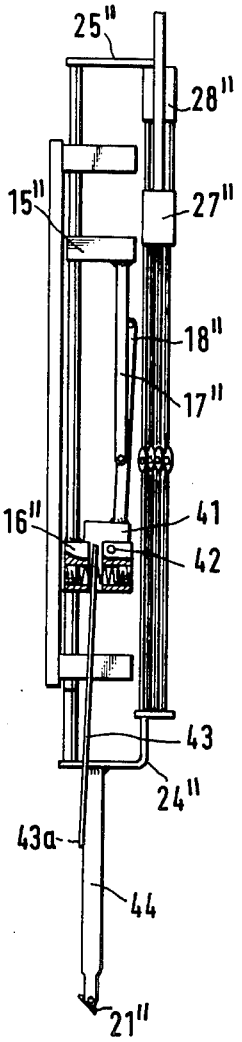
FIG.10
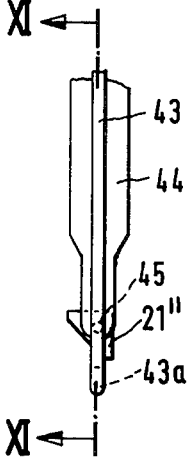
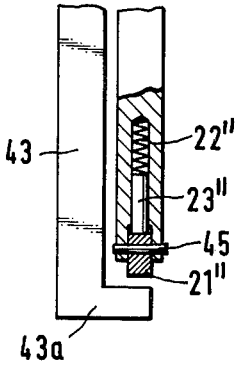
FIG.11

METHOD OF AND APPARATUS FOR FORMING A LENO SELVAGE ON WOVEN GOODS

BACKGROUND OF THE INVENTION

The present invention relates to a method of and apparatus for weaving. More particularly this invention concerns the forming of a leno selvage on woven goods.

In order to prevent the edge of a piece of woven goods from ravelling and to facilitate subsequent operations it is necessary to provide a selvage on the goods. Although it is frequent practice to use a definite weave such as a one end over two picks or a two-and-two basket construction, it has been found particularly advantageous to form the edge selvage as a leno weave. Such a leno weave is extremely strong and durable, since the crossing warp yarns lock the weft yarns in place.

It is known to form such a leno selvage by means of a doup mechanism comprising a doup heddle which is U-shaped and provided with an eye at its bight which receives the doup end or doup warp yarn. The U-shaped doup heddle is inverted and the ground warp yarn is passed between the two legs of the U-shaped doup heddle. During weaving the doup yarn is displaced in the weft direction from one side to the other of the ground yarns for alternate courses so that a tight leno weave is formed at least at the edge of the goods.

In such an arrangement wherein the shed formed when some of the warp yarns are displaced in a direction transverse to the warp direction they define is between 10 and 12 cm it is necessary therefore that these doup and ground yarns and the edge be similarly displaced. Thus it is necessary that the guide for the doup yarn at least move through a relatively great distance. This is complicated in relatively rapidly operating modern weaving machines. Thus when a leno selvage is desired it is often necessary to slow down the loom so that enough time is provided between each shedding operation for the doup yarns to move through their relatively long trajectories.

SUMMARY OF THE INVENTION

It is an object of the present invention to provide an improved method of and apparatus for weaving.

Another object is the provision of an improved method of and apparatus for forming a leno selvage in woven goods.

Yet another object is the provision of a relatively simple and fast-acting leno device which can operate in a high-speed modern loom.

These objects are attained according to the present invention in a leno selvage device having a support defining a rocking axis nondisplaceable in the weft direction and carrying a rocker which is pivotal about the axis between a pair of end positions. The doup heddle is operatively engageable with the rocker and deflectable thereby in the weft direction in the one end position of the rocker to one side of the ground heddle and in the other position of the rocker to the other side of the ground heddle. Means is provided for automatically displacing the rocker from whichever end position it is in to its opposite end position after deflection of the doup heddle. Thus as the doup heddle is moved toward and past the respective ground heddle it will be deflected first to one side of the ground heddle, then to the other. In this manner the doup warp yarn passing through the doup heddle will move from side to side of the ground warp yarn with each pick, forming a leno weave.

The doup heddle is, according to this invention, normally biased into a position directly in line in the shedding direction with the ground heddle. Thus, during the shedding operation the doup heddle and ground heddle move toward each other until the doup heddle strikes the deflecting surface of the rocker and is deflected to one side or the other of the ground heddle. On pulling back past the ground heddle according to this invention the doup heddle flips the rocker into the opposite position so that during the next reciprocation of the doup heddle toward the ground heddle it will automatically be deflected to the other side thereof and form the desired leno weave. Such an arrangement is extremely simple and completely avoids the complicated guide and control arrangements which have hitherto been used to form a leno selvage.

According to another feature of this invention the support is constituted by an arm which is displaceable in the shedding direction with the ground heddle. This arm can itself constitute the ground heddle and the rocker may be pivoted on its end. The doup heddle functioning with it is pivotally or elastically deflectable in the weft direction so that as the two come together the doup heddle is automatically deflected to one side and rides down the length of the arm constituting the ground heddle. Of course it is also possible to displace the ground heddle toward and away from the doup heddle, pushing it to one side or the other in the weft direction by means of the ground heddle.

According to another feature of this invention the ground heddle is connected to an arm constituting the support and extending away from the doup heddle. An extension on the doup heddle is engageable back past the ground heddle with the rocker of the ground heddle so as to swing the doup heddle from side to side.

It is noted that although discussion is limited to a single ground heddle and a single doup heddle, in reality a plurality of such doup heddles and a plurality of such ground heddles are connected together in order to form a tape selvage sufficiently wide to stabilize the edges of the woven goods. The use of a leno weave has the considerable advantage that it is possible to use a relatively thin band of such weave as the selvage so that there is minimal wastage and with normal tailoring this selvage will fit into the seams with no problem.

According to another feature of this invention each of the heddles is connected to an abutment which is engageable by any of the harnesses of the loom when these harnesses move away from the position with the healds aligned. Thus, whenever any one of the harnesses moves in one direction the ground heddle will be displaced toward the doup heddle and whenever any of the harnesses moves in the opposite direction the doup heddle will similarly be moved toward the ground heddle. Since no matter what the pattern being woven, at least one of the harnesses will move in one direction while another moves in another direction this ensures that the doup and ground heddles will be displaced toward each other. Thus, the device does not require a separate drive arrangement as the well-known prior art arrangement and can readily be added to an existing loom. Furthermore, this device can work with even the most complicated Jacquard loom so that no matter what the patterning the selvage device will produce a neat leno selvage. Indeed, only the heddles between the selvages heddles need be programmed, as these selvage heddles automatically will create a leno selvage, no matter what the other heddles are programmed to do.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 8 is a side view of yet another selvage arrangement according to the present invention;

FIG. 9 is a section through the arrangement of FIG. 8 taken along line IX—IX;

FIG. 10 is a large-scale view of a detail of the arrangement of FIGS. 8 and 9; and FIG. 11 is a section taken along line XI—XI of FIG. 10.

SPECIFIC DESCRIPTION OF PREFERRED EMBODIMENTS

Figures 1, 2, 3:
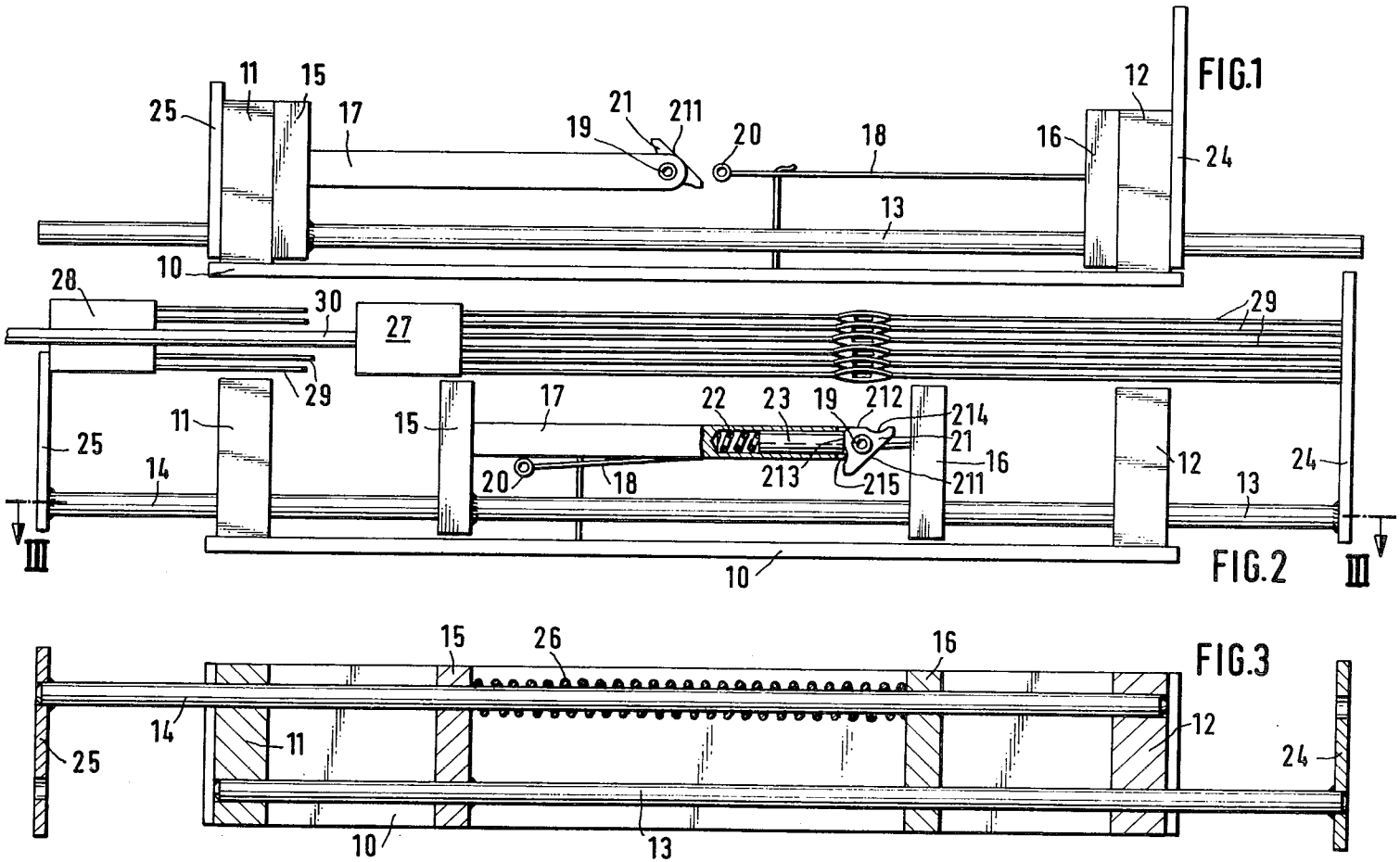
FIG. 1 is a top view of the leno selvage device according to this invention in the starting position.
FIG. 2 is a top view of the device showing it in the fully actuated position.
FIG. 3 is a section taken along line III—III of FIG. 2.
Figure 4:
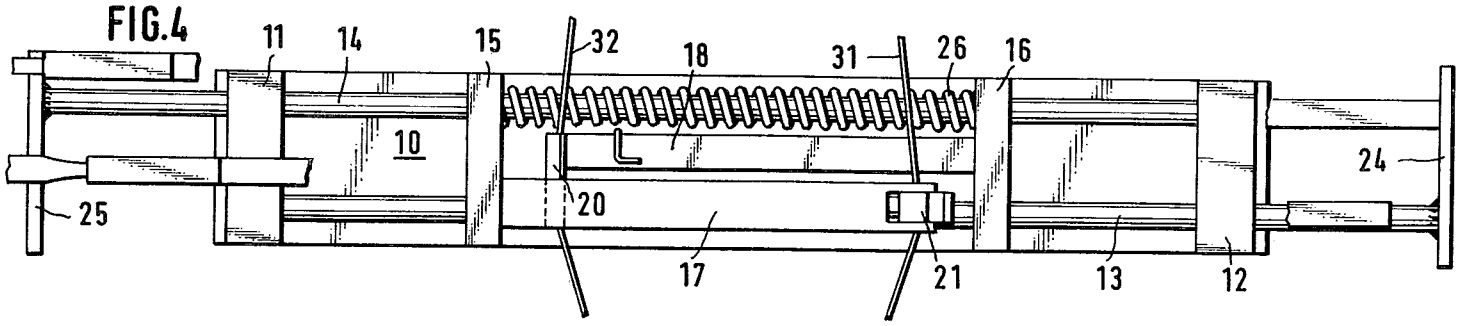
FIG. 4 is a side view of the device in the advanced position of FIG. 2.

As shown in FIGS. 1–4 a loom has a support plate 10 on which is mounted a pair of guides 11 and 12 spaced apart to opposite sides of the warp yarns in the loom. It is noted that FIGS. 1 and 2 are shown looking in the warp direction W*a*, FIG. 3 is looking in the shed direction, and FIGS. 3 and 4 are looking in the weft direction W*e*. Slidable through the uprights 11 and 12 are parallel rods 13 and 14 spaced apart in the warp direction W*a* and each fixed to a respective plate 15 and 16. The plate 15 carries a rigid arm constituting a ground heddle 17 and the plate 16 carries a flexible or elastically deformable arm constituting a doup heddle 18.

The heddles 17 and 18 extend in a shed direction S*h* and each have a respective eye or tube 19 and 20 opening in the warp direction. A ground warp yarn 31 (see FIG. 4) passes through the eye 19 and a doup warp yarn 32 through the eye 20.

Pivotal about a rocking axis defined by the tube or eye 19 at the end of the heddle 17 is a rocker 21 having a deflecting surface 211 which can be pivoted between the end positions shown in FIGS. 1 and 2. On its side opposite the surface 211 and each inclined at an angle of 45° to this flat surface 211 are holding surfaces 212 and 213 engageable with the end of a pusher-rod 23 displaceable in the shed direction in the hollow heddle 17 and pressed against the surfaces 212 and 213 by means of a compression spring 22.

An abutment plate or carrier 24 is carried on the far end of the rod 13 and a similar abutment plate or carrier 25 is carried on the far end of the rod 14. The loom here has two harnesses 27 and 28 displaceable by means of shafts 30 and each carrying a plurality of heddles 29 for respective warp yarns 29' shown in FIG. 1 without their heddles. The plates 24 and 25 are engageable with these harnesses 27 and 28 and with the free ends of the heddles 29 so that when any one of the harnesses is displaced in one direction away from a central position it will move the plate 25 to the left in FIG. 2 or the plate 24 to the right in FIG. 2. Since no matter what pattern is being woven at least one heddle is going to move in one direction for each pick and at least one heddle is going to move in the opposite direction this insures that during each pick the plates 24 and 25 will be pushed apart so that the eyes 19 and 20 constituting the ground and doup heddles, respectively, will move toward and past one another as described below. In addition the rod 14 is surrounded by a compression spring 26 which bears between the plates 15 and 16 carried on these rods 13 and 14, respectively, so as normally to urge them apart. Thus, the arrangement will always return to the position illustrated in FIG. 1 after displacement into the position shown in FIGS. 2 and 3 by movement of the harnesses 27 and 28.

The apparatus described above functions as follows:

When the harnesses 27 and 28 move the heddles 29 to form a main shed 29'' the eye 20 will move toward the eye 19. When eye 20, which is carried on the elastically resilient heddle 18 constituted as a thin steel band, engages the surface 211 it will be deflected to one side or the other of the heddle 17. Thus, the rocker 21 will deflect it to one side or the other of the heddle 17 so that the eye 20 will move down this heddle 17 to one side or the other in the weft direction of the eye 19.

Figure 5:
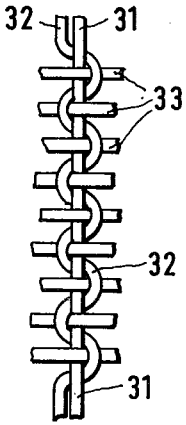
FIG. 5 is a detail view of a selvage according to this invention.

Once the position of FIG. 2 is assumed a weft yarn 33 (see FIG. 5) is shot through the shed formed by the heddles 29 and the heddle eyes 19 and 20.

Thereafter, the harnesses 27 and 28 return all of the heddles 29 to a central position so that the spring 26 can similarly move the eyes 19 and 20 back to their position of FIG. 1. As the eye 20 moves back up along the heddle 17, however, it will engage one of two return surfaces 214 or 215 on the back side of the rocker 21 between the surface 211 and the surfaces 212 and 213 so as to flip this rocker over into the other end position. During such rocking of the element 21 the spring 26 will be compressed, but once it assumes the other end position the pusher 23 will hold the rocker 21 firmly in place.

Thus, during the next shedding operation the same sequence as described above will take place, except that the eye 20 will be deflected to the opposite side of the heddle 17 in the weft direction. This forms the leno selvage shown in FIG. 5.

Figure 6:
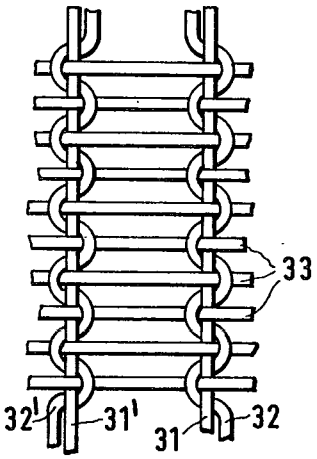
FIG. 6 is a detail view of another selvage according to this invention.

Since during every shedding or picking operation at least one of the heddles 29 will move in one direction and one of the heddles 29 in the opposite direction the device described above will always operate to form a leno weave along the edge of the goods being woven. It is of course possible to provide a plurality of such eyes 19 and 20 so as to form a leno selvage which is several warp yarns wide, or to form a double selvage using a second ground yarn 31' and a second doup yarn 32' as shown in FIG. 6. This arrangement of FIG. 6 is ideally suited for a split selvage used in the production of narrow fabrics on a relatively wide loom. The device described above can readily be fitted onto an existing loom so as to form a leno selvage no matter what weave is being produced. Indeed this arrangement can even be fitted onto a Jacquard loom and will function perfectly.

Figure 7:
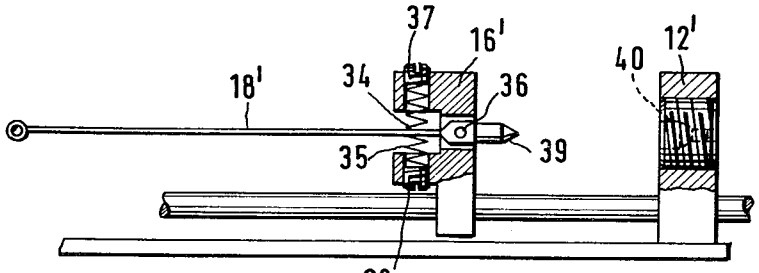
FIG. 7 is a top view partly in section of a detail of a variant of this invention.

It is possible as shown in FIG. 7 to replace the flexible band-type heddle 18 with a rigid heddle 18' pivoted on an axis 36 fixed in a support 16' similar to the support 16. Springs 34 and 35 adjustable by respective screws 37 and 38 serve to bias this heddle 18' into the illustrated central position. Furthermore, the rear end of the heddle 18' is formed with a centering cone 39 receivable in a similarly shaped sleeve 40 in a support 12' similar to the support 12. Such an arrangement readily allows the biasing force and the exact position of the eye at the end of the arm 18' to be adjusted.

The arrangement shown in FIGS. 8–11 is functionally similar. Here, two sliders 15" and 16" are provided which are operated by means of abutment plates 24" and 25" by harnesses 27" and 28", respectively. The slider 15" carries a rigid needle or heddle 17" and the slider 16" is provided with a heddle 18" having a rigid shaft which is connected to a support block 41 which is pivotal about an axis 42 in the slider 16". A control arm or extension 43 extending away from the heddle 18" on the block 41 coacts with a rocker 21".

This rocker 21" is carried on the end of a rigid support eye or shaft 44 which is rigidly mounted on the abutment plate 24" for the slider 15". The control arm 43 can slide during shedding with a bent-over end portion **43*a* on either of the sides of the rigid arm 44 and can reverse the rocker 21" as described above with reference to FIGS. 1–4. Thus, this control arm 43** functions in much the same manner as described above.

In addition as shown in FIGS. 10 and 11 the rigid shaft 44 which is pivotal about the axis 45 is provided with a spring 22" which presses a pusher rod 23" against the back of the rocker 21".

This arrangement also can be used in any conventional loom, of the circular, Jacquard, or any other type. It allows an extremely tight selvage to be produced which is so extremely compact and which locks the weft filaments so tightly in place that a very narrow selvage can be used, so that the woven goods produced by such a loom are as wide as possible.

It will be understood that each of the elements described above, or two or more together, may also find a useful application in other types of weaving systems differing from the types described above.

While the invention has been illustrated and described as embodied in a leno selvage device and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In combination with a loom having harnesses carrying an array of warp yarns defining a warp direction and displaceable in a shed direction transverse to said warp direction to form a main shed adapted to receive a weft passed through said shed in a weft direction transverse to said warp and shed directions, a leno selvage device comprising:

a ground heddle at an edge of said array and carrying a ground warp yarn, said ground heddle having a support defining a rocking axis nondisplaceable in said weft direction and jointly displaceable with said ground heddle in said shed direction;

a doup heddle at said edge carrying a doup warp yarn;

means for displacing said heddles synchronously with said harnesses in said shed direction oppositely toward and past each other to form an edge shed in line with said main shed;

a rocker pivotal on said support about said axis between a pair of end position, said doup heddle being operatively engageable with said rocker and deflectable thereby in said weft direction in one of said end positions to one side of said heddle and in the other end position to the other side of said ground heddle; and means carried on and jointly displaceable in said shed direction with said doup heddle and engageable with said rocker for displacing said rocker from said one end position into said other end position after deflection of said doup heddle to said one side and from said other end position into said one end position after deflection of said doup heddle to said other side of said ground heddle.

2. The combination defined in claim 1 wherein said ground heddle is constituted as a rigid arm having an end turned toward said doup heddle and constituting said support, whereby said rocker is mounted on said end of said arm.

3. The combination defined in claim 2 wherein said doup heddle is elastically deformable for lateral deflection of said doup warp yarn.

4. The combination defined in claim 1, further comprising a ground heddle carrier engageable by any of said harnesses on displacement thereof from a central position thereof to displace said ground heddle toward said doup heddle, a doup heddle carrier engageable by any of said harnesses on displacement thereof from a central position thereof to displace said doup heddle toward said ground heddle, and a spring urging said heddles away from each other.

5. The combination defined in claim 1, further comprising means for releasably securing said rocker in both of its said end positions.

6. The combination defined in claim 5 wherein said means for securing includes a pair of non-parallel surfaces on said rocker, a pusher engageable flatly against said surfaces in said end positions, and a spring urging said pusher against said surfaces.

7. In combination with a loom having harnesses carrying an array of warp yarns defining a warp direction and displaceable in a shed direction transverse to said warp direction to form a main shed adapted to receive a weft passed through said shed in a weft direction transverse to said warp and shed directions, a leno selvage device comprising:

a doup heddle at an edge of said array carrying a doup warp yarn and pivotal for displacement thereof in said weft direction;

a rigid ground heddle at said edge carrying a ground warp yarn and having an end turned toward said doup heddle and constituting a support defining a rocking axis nondisplaceable in said weft direction;

means for displacing one of said heddles synchronously with said harnesses toward and past the other heddle to form an edge shed in line with said main shed;

means for urging said doup heddle into a position aligned in said shed direction with said ground heddle;

a rocker pivotal on said end of said ground heddle at said support about said axis between a pair of end positions, said doup heddle being operatively engageable with said rocker and deflectable thereby in said weft direction in one of said end positions to one side of said ground heddle and in the other end position to the other side of said ground heddle; and means for displacing said rocker from said one end position into said other end position after deflection of said doup heddle into said one side and from said other end position into said one end position after deflection of said doup heddle to said other side of said ground heddle.

8. The combination defined in claim 7 wherein said means for urging includes at least one spring bearing against said shaft and means for varying the pressure said spring exerts on said shaft.

9. The combination defined in claim 7, further comprising means for aligning said doup heddle into a position aligned in said shed direction with said ground heddle and including a tapered centering formation on said shaft pointing away from said doup warp yarn and a fixed centering sleeve in which said formation is snugly engageable when said doup heddle is spaced relatively far from said ground heddle.

10. The combination defined in claim 9 wherein said centering sleeve is carried displaceable in said shed direction with said ground heddle.

11. In combination with a loom having harnesses carrying an array of warp yarns defining a warp direction and displaceable in a shed direction transverse to said warp direction to form a main shed adapted to receive a weft passed through said shed in a weft direction transverse to said warp and shed directions, a leno selvage device comprising:

a doup heddle at an edge of said array having an eye through which a doup yarn passes;

a rigid ground heddle at said edge having an end turned toward said doup heddle and provided with a tube through which a ground warp yarn passes and defining a rocking axis nondisplaceable in said weft direction;

means for displacing one of said heddles synchronously with said harnesses toward and past the other heddle to form an edge shed in line with said main shed;

a rocker pivotal on said tube about said rocking axis between a pair of end positions, said doup heddle being engageable with said rocker and deflectable thereby in said weft direction in one of said end positions to one side of said ground heddle and in the other end position to the other side of said ground heddle; and means for displacing said rocker from said one end position into said other end position after deflection of said doup heddle to said one side and from said other end position into said one end position after deflection of said doup heddle to said other side of said ground heddle.

12. In combination with a loom having harnesses carrying an array of warp yarns defining a warp direction and displaceable in a shed direction transverse to said warp direction to form a main shed adapted to receive a weft passed through said shed in a weft direction transverse to said warp and shed directions, a leno-selvage device comprising:

a ground heddle at an edge of said array and carrying a ground warp yarn, said ground heddle having an arm forming a support defining a rocking axis nondisplaceable in said weft direction;

a doup heddle at said edge carrying a doup warp yarn and having an extension, said arm extending on said ground heddle away from said doup heddle;

means for displacing one of said heddles synchronously with said harnesses toward and past the other heddle to form an edge shed in line with said main shed;

a rocker pivotal on said support about said axis between a pair of end positions, said extension of said doup heddle being engageable with said rocker for deflection of said doup heddle thereby in said weft direction in one of said end positions to one side of said ground heddle and in the other of said end positions to the other side of said ground heddle; and means for displacing said rocker from said one end position into said other end position after deflection of said doup heddle to said one side and from said other end position into said one end position after deflection of said doup heddle to said other side of said ground heddle.

* * * * *